United States Patent [19]

Hayase

[11] Patent Number: 4,565,746

[45] Date of Patent: Jan. 21, 1986

[54] IRON CORE FOR A STATIONARY INDUCTION APPARATUS

[75] Inventor: Iwao Hayase, Hyogo, Japan

[73] Assignee: Mitsubishi Denki Kabushiki Kaisha, Tokyo, Japan

[21] Appl. No.: 522,380

[22] PCT Filed: Oct. 28, 1982

[86] PCT No.: PCT/JP82/00421

§ 371 Date: Jun. 29, 1983

§ 102(e) Date: Jun. 29, 1983

[30] Foreign Application Priority Data

Oct. 30, 1981 [JP] Japan ..... 56-175340

[51] Int. Cl.[4] ..... H01F 27/24

[52] U.S. Cl. ..... 428/638; 428/928; 428/636; 336/234

[58] Field of Search ..... 428/611, 682, 928, 636–637, 428/638, 635; 336/234, 212, 211; 148/403

[56] References Cited

U.S. PATENT DOCUMENTS

| | | | |
|---|---|---|---|
| 4,201,837 | 5/1980 | Lupinski | 428/635 |
| 4,205,288 | 5/1980 | Lin et al. | 336/5 |
| 4,364,020 | 12/1982 | Lin et al. | 336/218 |
| 4,506,248 | 3/1985 | Lin | 336/234 |

FOREIGN PATENT DOCUMENTS

| | | | |
|---|---|---|---|
| 1804835 | 8/1980 | Fed. Rep. of Germany | 336/212 |
| 55-52207 | 4/1980 | Japan | 336/212 |
| 55-91810 | 7/1980 | Japan | 336/212 |

*Primary Examiner*—Peter K. Skiff
*Assistant Examiner*—John J. Zimmerman
*Attorney, Agent, or Firm*—Sughure, Mion, Zinn, Macpeak, and Seas

[57] ABSTRACT

An iron core for a stationary induction apparatus, such as a transformer or reactor, comprising an alternate laminate of thin amorphous magnetic strips (21*a* to 21*d*) and silicon steel sheets (11*a* to 11*d*). It is low in electrical loss, and high in workability.

4 Claims, 6 Drawing Figures

IRON CORE FOR A STATIONARY INDUCTION APPARATUS

TECHNICAL FIELD

This invention relates to an iron core for a stationary induction apparatus, such as a transformer or a reactor.

BACKGROUND ART

A laminated core for a stationary induction apparatus, such as a transformer or a reactor, has usually been formed from high-grade silicon steel sheets which contribute to energy and resource saving. Another material has recently been developed for use in the manufacture of an iron core for a stationary induction apparatus. It is a magnetic thin strip which enables a reduction in the electrical loss of the core to 20 to 80% of the electrical loss of a silicon steel sheet core.

The construction of these iron cores will be described with reference to FIGS. 1 and 2. In FIG. 1, 1*a* to 1*d* indicate silicon steel sheets, and in FIG. 2, 2*a* to 2*d* designate thin magnetic steel sheets cut from, for example, a thin amorphous magnetic strip, thin ferronickel strip or thin quenched ferrosilicon strip. 1*a* and 1*b*, or 2*a* and 2*b* are leg members, and 1*c* and 1*d*, or 2*c* and 2*d* are yoke members connecting the leg members 1*a* and 1*b*, or 2*a* and 2*b*. The core members 1*a* to 1*d*, or 2*a* to 2*d* are laminated with a minimum joint clearance to form a laminated core for a stationary induction apparatus.

The laminated core composed of silicon steel sheets as shown in FIG. 1 can be efficiently produced, since it is easy to obtain a desired shape. It is, however, very difficult to obtain a laminated core having a small loss, since it is presently difficult to expect any further improvement in the magnetic properties of silicon steel sheets.

It is easy to obtain a laminated core having a small loss from thin amorphous magnetic steel sheets as shown in FIG. 2, since they ensure a small electrical loss. A further improvement in their properties can be expected. A thin magnetic strip is produced by cooling hot molten material rapidly as it is blown against a roller or the like moving at an ultrahigh speed. This method involves a lot of technical difficulty, and presently enables the production of only a magnetic core material having a thickness of, say, 100 μm and a width of, say, 2 inches. The production of a laminated core from this material involves a great deal of difficulty.

It has hitherto been impossible to obtain an inexpensive laminated core for a stationary induction apparatus having a small electrical loss if only either silicon steel sheets or thin amorphous magnetic strips are employed. The former material has the disadvantages of failing to achieve a satisfactory reduction in electrical loss, while the latter has the disadvantage of being very low in workability.

DISCLOSURE OF THE INVENTION

This invention provides an iron core for a stationary induction apparatus comprising alternately laminated thin amorphous magnetic strips and silicon steel sheets. It is low in electrical loss, and high in workability.

BEST MODE OF CARRYING OUT THE INVENTION

Figure 1:
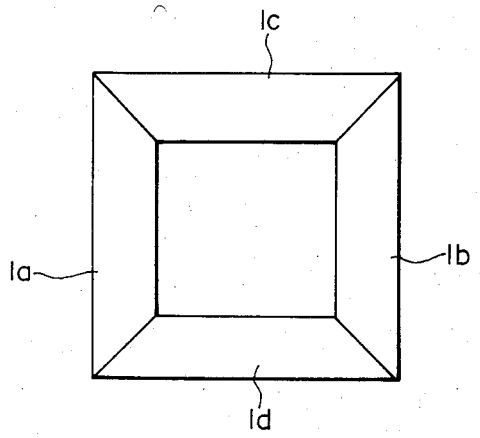
FIG. 1 PRIOR ART
FIG. 1 is a top plan view of a conventional iron core composed of silicon steel sheets.
Figure 2:
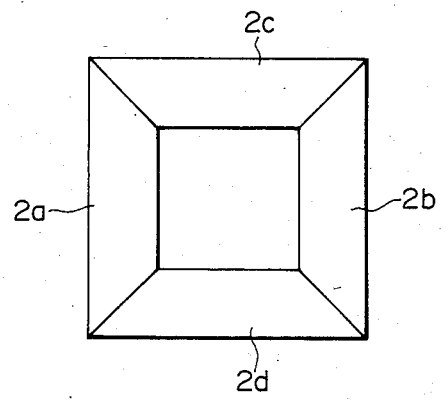
FIG. 2 PRIOR ART
FIG. 2 is a top plan view of a conventional iron core composed of amorphous magnetic thin strips.
Figure 3:
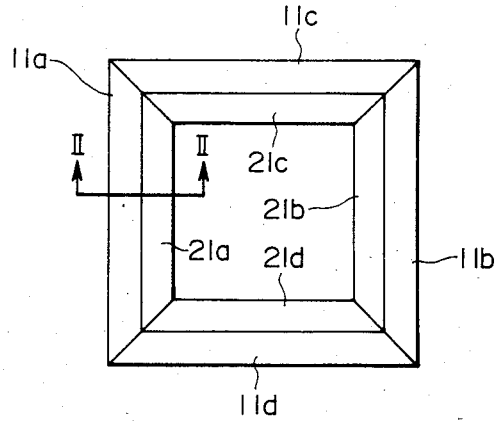
FIG. 3 is a top plan view showing an embodiment of this invention.
Figure 4:
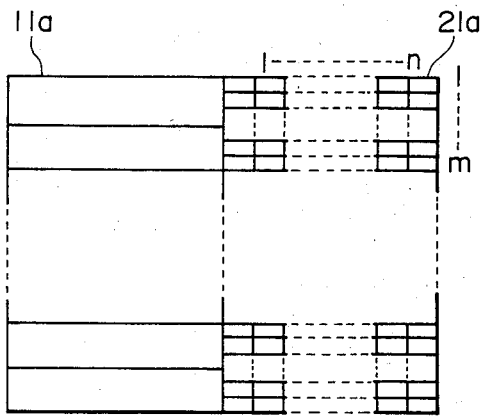
FIG. 4 is a sectional view taken along the line IV—IV of FIG. 3.

The invention will be described with reference to the drawings. In FIG. 3, 11*a* to 11*d* indicate silicon steel sheets laid in a plurality of layers, and 21*a* to 21*d* denote thin amorphous magnetic strips laid in a plurality of layers. They are juxtaposed in a single layer as shown in FIG. 4. 11*a*, 11*b*, 21*a* and 21*b* are leg members, and 11*c*, 11*d*, 21*c* and 21*d* are yoke members connecting the leg members 11*a*, 11*b*, 21*a* and 21*b*. They are laminated with a minimum joint clearance.

The thin amorphous magnetic strips 21*a* to 21*d* are presently available only in a thickness of 100 μm and a width of 2 inches, as stated before. The silicon steel sheets 11*a* to 11*d* are available in a thickness of 0.28, 0.30 or 0.35 mm. Therefore, the strips 21*a* to 21*d* are employed in a plurality m of layers and a plurality n of rows, as shown in FIG. 4, depending on the thickness of the silicon steel sheets 11*a* to 11*d*, and the capacity of the core required. This arrangement enables utilization of the advantages of the two kinds of materials employed, i.e., the small electrical loss of the thin amorphous magnetic strips and the high workability of the silicon steel sheets.

Figure 5:
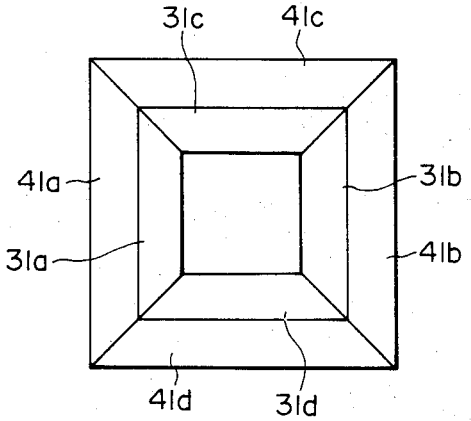
FIGS. 5 and 6 are top plan views showing other embodiments of this invention.
Figure 6:
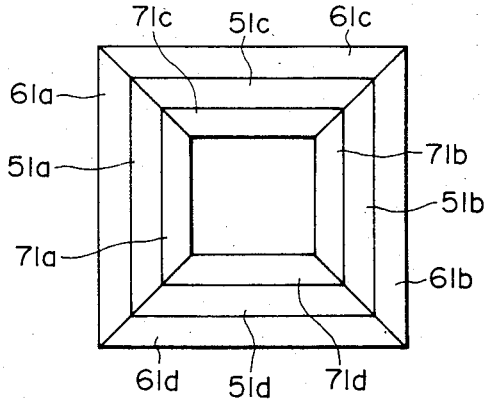

Although the thin amorphous magnetic strips are disposed inwardly of the silicon steel sheets according to the embodiment hereinabove described, it is possible to dispose thin amorphous magnetic strips 41*a* to 41*d* outwardly of silicon steel sheets 31*a* to 31*d*, as shown in FIG. 5. It is also possible to obtain the same results by disposing thin amorphous magnetic strips 51*a* to 51*d* between silicon steels sheets 61*a* to 61*d*, and 71*a* to 71*d*, as shown in FIG. 6.

Although the invention has been described with reference to iron cores for single-phase transformers, it is equally applicable to laminated cores for other stationary induction apparatuses, such as a polyphase transformer having three or more phases, or a reactor.

I claim:

1. A magnetic core for a stationary induction apparatus comprising a plurality of laminates stacked in a first direction, each said laminate comprising an alternate laminate of a thin substantially unbent amorphous magnetic strip and a substantially unbent silicon steel sheet, said strip and sheet being disposed to each other in a second direction perpendicular to said first direction, wherein each said laminate comprises a plurality of silicon steel sheets disposed inwardly and outwardly of said thin amorphous magnetic strip.

2. A magnetic core for a stationary apparatus comprising a plurality of laminates stacked in a first direction, each said laminate comprising an alternate laminate of a thin substantially unbent amorphous magnetic strip and a substantially unbent silicon steel sheet, said strip and sheet being disposed to each other in a second direction perpendicular to said first direction, wherein said silicon steel sheet is disposed inwardly of said thin amorphous magnetic strip, and closer to the center of said core.

3. A magnetic core comprising a plurality of laminates stacked in a first direction, each said laminate comprising an alternate laminate of a thin substantially unbent amorphous magnetic strip and a substantially unbent silicon steel sheet, said silicon steel sheet being disposed inwardly of said amorphous magnetic strip and closer to the center of said core in a second direction perpendicular to said first direction, wherein each said amorphous magnetic strip comprises a plurality of contiguous amorphous magnetic sheets disposed along said first direction.

4. A magnetic core as recited in claim 3, wherein said plurality of amorphous magnetic sheets are additionally disposed along said second direction.

* * * * *